US011009275B2

(12) United States Patent
Khaire

(10) Patent No.: US 11,009,275 B2
(45) Date of Patent: May 18, 2021

(54) COMPRESSOR PROTECTION AGAINST LIQUID SLUG

(71) Applicant: Rheem Manufacturing Company, Atlanta, GA (US)

(72) Inventor: Swapnil Khaire, Fayetteville, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 146 days.

(21) Appl. No.: 16/158,966

(22) Filed: Oct. 12, 2018

(65) Prior Publication Data

US 2020/0116404 A1 Apr. 16, 2020

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2400/053* (2013.01); *F25B 2400/054* (2013.01); *F25B 2500/03* (2013.01); *F25B 2500/06* (2013.01); *F25B 2500/28* (2013.01); *F25B 2600/25* (2013.01); *F25B 2700/1933* (2013.01); *F25B 2700/21151* (2013.01)

(58) Field of Classification Search
CPC ..... F24F 2140/12; F24F 2140/20; F25B 2400/051; F25B 2400/053; F25B 2400/054; F25B 2500/02; F25B 2500/06; F25B 2500/28
See application file for complete search history.

(56) References Cited

U.S. PATENT DOCUMENTS

| | | | | |
|---|---|---|---|---|
| 3,130,558 | A | 4/1964 | Gardner | |
| 3,651,657 | A * | 3/1972 | Bottum | B60H 1/3204 62/196.3 |
| 4,506,519 | A | 3/1985 | Morse et al. | |
| 4,537,045 | A * | 8/1985 | Mayer | F25B 43/00 62/503 |
| 4,856,288 | A | 8/1989 | Weber | |
| 5,622,055 | A * | 4/1997 | Mei | F25B 40/00 62/113 |
| 6,298,687 | B1 * | 10/2001 | Dienhart | B60H 1/00342 62/471 |
| 6,681,597 | B1 * | 1/2004 | Yin | F25B 40/00 62/503 |
| 7,690,219 | B2 * | 4/2010 | Suzuki | F25B 9/008 62/475 |
| 8,578,731 | B2 * | 11/2013 | Jin | F25B 13/00 62/324.4 |
| 2017/0016660 | A1 * | 1/2017 | Nishiyama | F25B 40/00 |

* cited by examiner

*Primary Examiner* — Jonathan Bradford
(74) *Attorney, Agent, or Firm* — Troutman Pepper Hamilton Sanders LLP

(57) ABSTRACT

A liquid slug reduction and charge compensator device for use in air conditioning and heat pump systems includes a housing having a cavity. The housing includes an inlet port providing an entry path into the cavity and an outlet port providing an exit path from the cavity. The housing further includes a liquid line port providing a refrigerant pathway into and out of the cavity. The liquid slug reduction and charge compensator device further includes a flash tube extending through the cavity and providing a passageway through the cavity such that a hot gas refrigerant that enters the cavity through the inlet port causes a liquid refrigerant that enters the flash tube to evaporate.

13 Claims, 7 Drawing Sheets

COMPRESSOR PROTECTION AGAINST LIQUID SLUG

TECHNICAL FIELD

The present disclosure relates generally to air conditioning and heat pump systems, and more particularly to the protection of compressors of such systems against refrigerant liquid slug.

BACKGROUND

Compressors used in air conditioning systems and heat pump systems are designed to compress vapor refrigerant. However, a liquid refrigerant may accumulate in the air conditioning and heat pump systems during long idle periods and as a result of rapid change in operating conditions. Because of the incompressibility of liquids, it is desirable to prevent a liquid refrigerant from reaching a compressor. In some cases, an accumulator may be used in the refrigerant path to the compressor (i.e., in a suction line to the compressor) to prevent a refrigerant from reaching the compressor in a liquid form. However, the slow transfer of the refrigerant from the accumulator to the compressor may be an undesirably long process. Thus, a solution that efficiently reduces the risk of damage to a compressor from liquid slug may be desirable.

SUMMARY

The present disclosure relates generally to air conditioning and heat pump systems, and more particularly to the protection of compressors of such systems against slug. In some example embodiments, a liquid slug reduction and charge compensator device for use in heat pump systems includes a housing having a cavity. The housing includes an inlet port providing an entry path into the cavity and an outlet port providing an exit path from the cavity. The housing further includes a liquid line port providing a refrigerant pathway into and out of the cavity. The liquid slug reduction and charge compensator device further comprises a flash tube extending through the cavity and providing a passageway through the cavity such that a hot gas refrigerant that enters the cavity through the inlet port causes a liquid refrigerant that enters the flash tube to evaporate.

In another example embodiment, a slug reduction system for use in heat pump systems includes a slug reduction and charge compensator device that includes a housing having a cavity and a liquid line port providing a refrigerant pathway into and out of the cavity. The slug reduction and charge compensator device further includes a flash tube extending through the cavity and providing a passageway through the cavity for a suction line refrigerant to flow through the flash tube. The slug reduction system further includes a valve assembly configured to control whether the cavity is fluidly coupled to a hot gas refrigerant pipe through an inlet port of the housing, where the hot gas refrigerant pipe is designed to carry a hot gas refrigerant from a compressor.

In another example embodiment, a heat pump system includes a compressor and a slug reduction and charge compensator device that includes a housing having a cavity and a liquid line port providing a refrigerant pathway into and out of the cavity. The slug reduction and charge compensator device further includes a flash tube extending through the cavity, where the flash tube provides a passageway through the cavity for a suction line refrigerant to flow through the flash tube. The heat pump system further includes a valve assembly configured to control whether the cavity is fluidly coupled to a discharge line outlet of the compressor through an inlet port of the housing to receive a hot gas refrigerant from the compressor.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
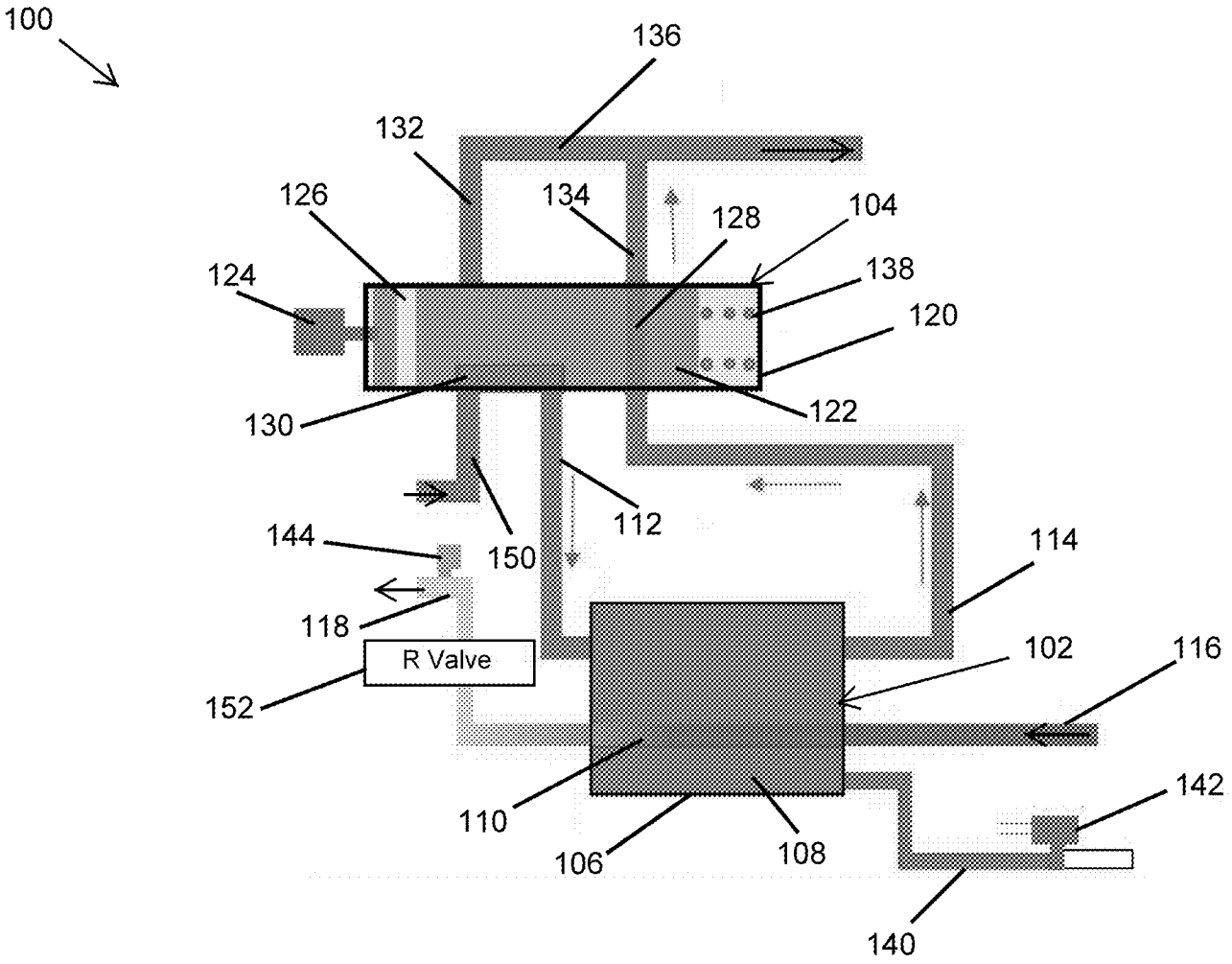
FIG. 1 illustrates a slug reduction system configured for flashing a liquid refrigerant in a heat pump system according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings may designate like or corresponding, but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

In some example embodiments, a slug reduction device may be used to flash (i.e., vaporize) a liquid refrigerant that is in a suction line of heat pump and air conditioning systems into a vapor form. By routing a refrigerant that flows in a suction line through a slug reduction device and by directing a hot gas refrigerant from a compressor into the slug reduction device, the relatively high temperature of the hot gas refrigerant may result in the flashing of a liquid refrigerant as the liquid refrigerant passes through the slug reduction device. In some cases, a temperature and pressure sensor or another type of sensor may be used to determine whether the refrigerant in the section of the suction line connected to a suction line inlet of a compressor is/includes a liquid refrigerant. If the suction line has a liquid refrigerant based on the sensor information, a hot gas refrigerant from the discharge line outlet of the compressor may be routed to the slug reduction device to flash the liquid refrigerant as the refrigerant passes through the slug reduction device.

Turning now to the figures, particular example embodiments are described. FIG. 1 illustrates a slug reduction system 100 configured for flashing a liquid refrigerant in a heat pump system according to an example embodiment. That is, the slug reduction system 100 as shown in FIG. 1 may be in a configuration for use during slug reductions/prevention operations of a heat pump system. In some example embodiments, the slug reduction system 100 may also be used in an air conditioning system.

In some example embodiments, the slug reduction system 100 includes a slug reduction device 102 and a valve assembly 104. The slug reduction device 102 may also be referred to herein as a slug reduction and charge compensator device because the slug reduction device 102 may effectively operate as a charge compensator of a heat pump system as described below in more detail. The slug reduction device 102 may include a housing 106 having a cavity 108. The slug reduction device 102 may also include a flash tube 110 extending through the cavity 108. A coupling pipe 112 and a coupling pipe 114 may be coupled to and between the slug reduction device 102 and the valve assembly 104. The pipes 112, 114 may carry a refrigerant between the valve assembly 104 and the slug reduction device 102. For example, a hot gas refrigerant may travel from the valve assembly 104 to the slug reduction device 102 through the pipe 112 and from the slug reduction device 102 to the valve assembly 104 through the pipe 114.

In some example embodiments, a pipe 132, a pipe 134, and a pipe 150 are coupled to the valve assembly 104. The pipes 132, 134 may carry a hot gas refrigerant that travels through the pipe 150 and passes through the valve assembly 104 directly or via the slug reduction device 102. The pipes 132, 134 may be fluidly coupled to each other outside of the valve assembly 104 such that the hot gas refrigerant that enters the pipe 132 may travel to the pipe 134, and vice versa. For example, the pipes 132, 134 may be coupled to a pipe 136 that is connected to a discharge line of an air conditioning or heat pump system.

In some example embodiments, when the slug reduction system 100 is in an air conditioning or a heat pump system, the pipe 150 may be coupled to a discharge line output of a compressor and may carry a hot gas refrigerant from the compressor to the valve assembly 104. The refrigerant from the discharge line output of a compressor generally has a high temperature and is in a vapor form as well known by those of ordinary skill in the art. For example, the temperature of the hot gas refrigerant from the compressor may be in excess of 200 degrees F.

Figure 2:
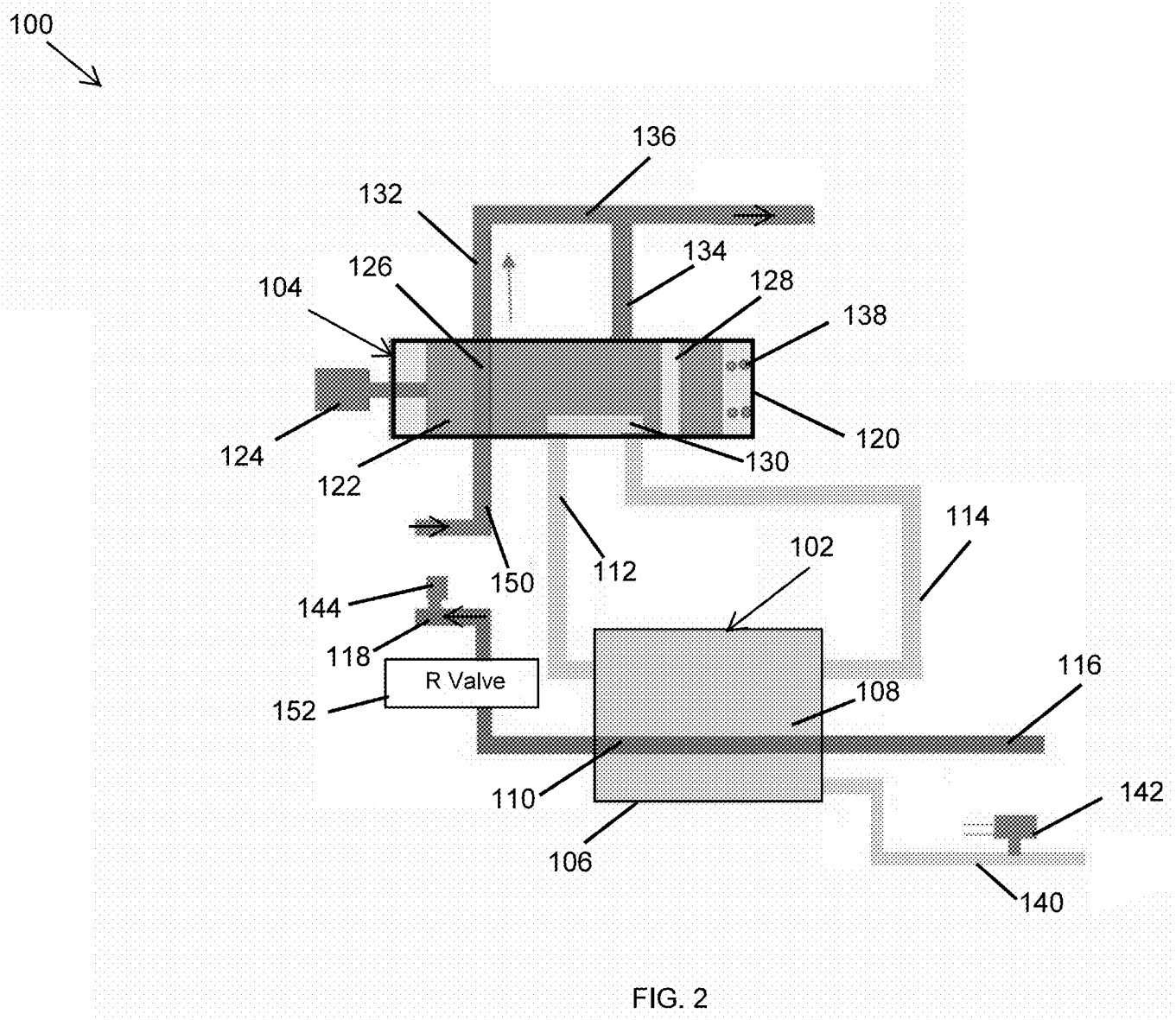
FIG. 2 illustrates a slug reduction system configured for a normal operation of a heat pump system according to an example embodiment.

In some example embodiments, a pipe 140 may be coupled to the slug reduction device 102. For example, during heating mode operations, the pipe 140 may be used for the transfer of a refrigerant from a liquid line pipe of a heat pump system to the slug reduction device 102. During cooling mode operations, the pipe 140 may be used for the transfer of a refrigerant from the slug reduction device 102 to the liquid line pipe of the heat pump system. For example, the refrigerant that is transferred from the slug reduction device 102 through the pipe 140 during a cooling mode operation may be the refrigerant that was pulled out of the heat pump system during a heating mode operation. In some example embodiments, the slug reduction device 102 may effectively operate as a charge compensator of a heat pump system, for example, when system 100 is configured as shown in FIG. 2.

In some example embodiments, a flow valve 142 may control the flow of a refrigerant through the pipe 140 to and from the slug reduction device 102. The valve 142 may be controlled by a control device to open and close the valve 142 based on the mode of operation of the slug reduction system 100. As shown in FIG. 1, the flow valve 142 may be closed, thereby preventing a flow of a refrigerant in the pipe 140 from one side of the valve 142 to the other.

In some example embodiments, the housing 106 includes openings (also referred to herein as ports) that allow a refrigerant to flow into and out of the cavity 108. To illustrate, the pipe 112 may be coupled to the housing 106 such that a refrigerant can flow through the pipe 112 into the cavity 108 through an opening/inlet port of the housing 106. A pipe 114 may also be coupled to the housing 106 such that a refrigerant can flow from the cavity 108 to the pipe 114 through an opening/outlet port of the housing 106.

In some example embodiments, the housing 106 may also include another opening/liquid line port for a refrigerant to flow to and from the cavity 108. For example, the pipe 140 may be coupled to the housing 106 such that a refrigerant can flow between the cavity 108 of the housing 106 and the pipe 140 through the opening/liquid line port.

In some example embodiments, the flash tube 110 extending through the cavity 108 may provide a passageway through the cavity 108 for a refrigerant to flow through. For example, the flash tube 110 may be coupled to pipes 116, 118 such that a refrigerant may flow from the pipe 116 to the pipe 118 through the flash tube 110. To illustrate, the slug reduction device 102 may be installed in a heat pump system such that a refrigerant flows through the pipe 116, the tube 110, and the pipe 118 to the suction line inlet of the compressor of the system. For example, the pipe 118 may be a suction line pipe, and a reversing valve 152 may be configured such that the flash tube 110 is fluidly coupled to the pipe 118 through the reversing valve 152.

In some example embodiments, the valve assembly 104 includes a housing 120, a valve core 122 that is inside of the housing 120, and a solenoid 124. The valve assembly 104 may also include a spring 138 that is inside the housing 120. The flow of a refrigerant through the valve assembly 104, and thus, through the slug reduction system 100, depends on the position of the valve core 122 inside the housing 120. The position of the valve core 122 inside the housing 120 may depend on the solenoid 124 and the spring 138.

To illustrate, the solenoid 124 may exert a force to push the valve core 122 toward the spring 138 such that the valve core 122 is in a particular position (e.g., the position of the valve core 122 shown in FIG. 2). As long as the solenoid 124 maintains the force on the valve core 122, the valve core 122 may stay in the particular position. When the solenoid 124 is not exerting a force on the valve core 122 to push the valve core 122 toward the spring 138, the spring 138, which was previously compressed, may push the valve core 138 toward the solenoid 124 and position the valve core 122 in the position shown in FIG. 1.

In some example embodiments, the housing 120 may include openings (also referred to herein as ports) that may allow fluid flow through the valve assembly 104 depending on the position of the valve core 122 in the housing 120. To illustrate, the housing 120 and the valve core 122 may provide a flow channel 130, where a refrigerant can flow through the channel 130 between openings/ports of the housing 120. For example, the pipe 150 may be coupled to the housing 120 such that a hot gas refrigerant can flow from the pipe 150 into the channel 130 through an opening/port of the housing 120 when the valve core 122 is positioned as shown in FIG. 1. The hot gas refrigerant can then flow from the channel 130 to the pipe 112 through another opening in the housing 106 when the valve core 122 is positioned as shown in FIG. 1. Thus, when the valve core 122 is positioned as shown in FIG. 1, a hot gas refrigerant can flow through a flow path that includes the pipe 150, the channel 130, and the pipe 112 to enter the cavity 108 of the housing 106 of the slug reduction device 102.

In some example embodiments, the housing 120 may include another opening/port, and the pipe 114 may be attached to the housing 120 such that a fluid can flow from the pipe 114 into the housing 120 through the opening/port. For example, a hot gas refrigerant may flow from the cavity 108 of the housing 106 of the slug reduction device 102 into the housing 120 of the valve assembly 104 through the pipe 114 and the opening/port of the housing 120.

In some example embodiments, the pipes 132, 134 may also be attached to the housing 120 such that a refrigerant, such as a hot gas refrigerant, can flow into the pipes 132, 134 through respective openings/ports in the housing 120. To illustrate, the valve core 122 may include fluid passageways 126, 128 that extend through the valve core 122 providing a flow path for a refrigerant to pass through the valve core 122. The position of the valve core 122 in the housing 120 determines whether the passageway 126 or the passageway 128 is aligned with openings/ports of the housing 120. For example, in the position of the valve core 122 shown in FIG. 1, the passageway 128 is aligned with openings/ports of the housing 120 and the pipes 114 and 134. A flow path from the cavity 108 of the housing 106 may include the pipe 114, the passageway 128, and the pipe 134 such that a hot gas refrigerant can flow from the cavity 108 of the housing 106 to the pipe 134.

In some example embodiments, a sensor 144 may be used to determine whether a refrigerant in the pipe 118 is in a liquid form. For example, the sensor 144 may include temperature and pressure sensor elements that sense the temperature and pressure in the pipe 118. For example, the sensor 144 may provide the temperature and pressure information to a control device that may control the valve assembly 104 and the flow valve 142 based on the information. In some alternative embodiments, the sensor 144 may be a liquid sensor that senses the presence of a refrigerant that is in a liquid form in the pipe 118. In some example embodiments, another type of sensor that can provide information about the refrigerant in the pipe 118 may be used.

In some example embodiments, the system 100 may be configured as shown in FIG. 1 to flash into a vapor a liquid refrigerant that flows into the flash tube 110 of the slug reduction device 102 through the pipe 116. For example, the system 110 may be configured as shown in FIG. 1 based on information from the sensor 144. To illustrate, the pipe 150 may be fluidly coupled to a compressor discharge line outlet, and a hot gas refrigerant may flow from the pipe 150 into the cavity 108 of the housing 106 through a flow path that includes the pipe 150, the channel 130 of the valve assembly 104, and the pipe 112. The hot gas refrigerant may then exit the cavity 108 and flow to the pipe 136 through a flow path that includes the pipe 114, the fluid passageway 128, and the pipe 134. The pipe 136 may be coupled to or may be a section of the discharge line of a heat pump or air conditioning system. Because a flow path from and to the cavity 108 through the pipe 140 is closed by the valve 142, the hot gas refrigerant that enters the cavity does not flow past the valve 142.

As the hot gas refrigerant travels from the pipe 150 to the pipe 136 through the cavity 108, the relatively high temperature of the hot gas refrigerant may result in the flashing of a liquid refrigerant that enters the flash tube 110 of the slug reduction device 102 from the pipe 116, which may be fluidly coupled to the suction line piping of a heat pump. As a result of the flashing of at least a portion of a liquid refrigerant that enters the tube 110, the refrigerant that reaches a suction line inlet of a compressor through the slug reduction device 102 and the pipe 118 may be entirely or mostly in vapor form.

By flashing/vaporizing a liquid refrigerant in the suction line of an air conditioning or heat pump system, the slug reduction system 100 can reduce the amount of liquid refrigerant that reaches a compressor. The slug reduction device 102 can quickly flash/vaporize a liquid refrigerant and thus can reduce or eliminate the amount of liquid refrigerant in a suction line that reaches a compressor. By eliminating or reducing the amount of liquid refrigerant that reaches the compressor, the slug reduction system 100 may reduce the risk of damage to the compressor.

In some example embodiments, the slug reduction device 102 and the pipes 112, 114, 116, 118, 132, 136, 140, and 150 may be made from copper, brass, another suitable material, or a combination of two or more thereof. For example, the housing 106 may be a spun copper housing. Methods such as spinning, cutting, milling, soldering, etc. may be used to make the device slug reduction device 102. For example, the slug reduction device 102 may be made using similar methods and materials as those used in the manufacturing of charge compensators used in heat pump systems. The sizes of the housing 106 and the pipes may depend on the capacity of the heat pump system that uses the slug reduction device 102 as can be readily understood by those of ordinary skill in the art with the benefit of this disclosure. In some example embodiments, different pipes and other components of the system 100 may be coupled using methods such as brazing, riveting, etc.

In general, each pipe in the system 100 may include multiple pipes. In some example embodiments, pipes, openings, etc. that are fluidly coupled to each other, i.e., a fluid can flow from one to the other, may have other components, such as one or more other pipes, in between that allow for the flow of a fluid therethrough from one to the other. In some example embodiments, the system 100 may include other components without departing from the scope of this disclosure. In some alternative embodiments, one or more of system 100 may be omitted. In some alternative embodiments, the reversing valve 152 may be omitted, replaced by one or more other components, or coupled to the system 100 in a different manner than shown in FIG. 1 without departing from the scope of this disclosure.

In some alternative embodiments, the system 100 may use a different valve assembly or multiple valves instead of the valve assembly 104 to perform the operations of the system 100. In some example embodiments, the slug reduction device 102 and the valve assembly 104 may have different shapes than shown without departing from the scope of this disclosure.

In some example embodiments, the valve 142 and the sensor 144 may be at different locations than shown without departing from the scope of this disclosure. For example, the sensor 144 may be located to the right of the slug reduction device 102 to detect a liquid refrigerant before the refrigerant enters the slug reduction device 102. Alternatively, a different sensor may be located to the right of the slug reduction device 102.

FIG. 2 illustrates the slug reduction system 100 configured for a normal operation of a heat pump system according to an example embodiment. In some example embodiments, the slug reduction system 100 may also be used in an air conditioning system. In FIG. 2, the valve core 122 of the valve assembly 104 is positioned to allow a normal heating or cooling operation of a heat pump system. To illustrate, in contrast to FIG. 1, in FIG. 2, the solenoid 124 has pushed the valve core 122 toward the spring 138 such that the pipe 150 is aligned with an opening/port of the housing 120, the fluid passageway 126, and the pipe 132 that is attached to the housing 120 aligned with an opening/port of the housing 120. The valve core 122 is positioned such that a hot gas refrigerant from a discharge line outlet of a compressor can flow to the pipe 136 through a flow path that includes the pipe 150, the passageway 126, and the pipe 132. Because the fluid passageway 128 is unaligned with openings of the housing 120 and the respective pipes 114, 134, the passageway 128 may not be in a flow path of a refrigerant when the valve core 122 is positioned as shown in FIG. 2.

In some example embodiments, the pipe 114 may be fluidly coupled to the pipe 112 through the flow channel 130 of the valve assembly 104. The coupling of the pipe 112 and the pipe 114 through the flow channel 130 establishes a closed loop through the cavity 108 of the housing 106. A refrigerant that exits the cavity 108 through an opening/port of the housing 106 to the pipe 114 may flow through a flow path that includes the pipe 114, the flow channel 130, and the pipe 112 and return back to the cavity 108 through another opening/port of the housing 106. The lighter shading of the cavity 108, the pipes 112, 114, and the flow channel 130 in FIG. 2 in contrast to their darker shading in FIG. 1 is intended to show that the hot gas refrigerant is not flowing through the cavity 108, the pipes 112, 114, and the flow channel 130 in the system configuration shown in FIG. 2. For example, in FIG. 2, refrigerant pulled out of circulation through the pipe 140 may be present or may flow in the cavity 108, the pipes 112, 114, and/or the flow channel 130.

In some example embodiments, the slug reduction device 102 may operate as a charge compensator by pulling some refrigerant out of circulation through the pipe 140 during heating mode or cooling mode operations depending on system design and by returning the refrigerant into circulation through the pipe 140 during cooling mode operations. For example, the pipe 140 may be fluidly coupled to the liquid line pipe of the heat pump system during regular heating and cooling mode operations. During heating mode operations, the reversing valve 152 may be configured such that the pipe 116 is fluidly coupled to the pipe 118 through the flash tube 110 of the slug reduction device 102 and through the reversing valve 152. That is, during heating mode operations, the pipe 116 may be part of the suction line of the heat pump system such that refrigerant flows from the pipe 116 to the pipe 118, which may be a suction line pipe of the heat pump system.

During cooling mode operations, the refrigerant that was pulled into the housing 106 during heating mode operations may be returned into circulation through the pipe 140. To illustrate, during cooling mode operations, the reversing valve 152 may be configured such that the discharge line outlet of a compressor is fluidly coupled to the pipe 116 through the reversing valve 152 and through the flash tube 110 of the slug reduction device 102. For example, during cooling mode operations, a hot gas refrigerant from a compressor may flow to the pipe 116 through a flow path that includes the pipe 150, the passageway 126, the pipe 136, the reversing valve 152 and the flash tube 110. That is, the pipe 136 may be fluidly coupled to the reversing valve 152 allowing a refrigerant to flow from the pipe 136 to the pipe 116 through the reversing valve 152 and the flash tube 110.

In some example embodiments, during normal heating and cooling mode operations of a heat pump system, the flow valve 142 is open, which allows refrigerant to flow to and from the cavity 108 through the pipe 140. Because the refrigerant flow path through the pipe 140 is open and because cavity 108, the pipes 112, 114, and the flow channel form a closed system, the slug reduction device 102 may operate as a charge compensator.

In some example embodiments, the system 100 may switch or transition from the flow configuration shown in FIG. 1 to the flow configuration shown in FIG. 2 after operating in the configuration of FIG. 1 for a period of time that depends on a number of factors including system capacity, etc. For example, the period of time that a heat pump system that includes the slug reduction system 100 operates in the configuration of FIG. 1 may depend on the capacity of the heat pump system. In some example embodiments, the system 100 may switch or transition from the flow configuration shown in FIG. 1 to the flow configuration shown in FIG. 2 if no liquid refrigerant is indicated or detected in the suction line of a heat pump system by the sensor 144 for a period of time that depends on a number of factors including system capacity, etc.

In some example embodiments, the system 100 may switch or transition from the flow configuration shown in FIG. 2 to the flow configuration shown in FIG. 1 if the sensor 144 indicates a presence of liquid refrigerant in the suction line of a heat pump system. The system 100 may also start in the flow configuration shown in FIG. 1 when a heat pump system that includes the slug reduction system 100 is started up.

By operating in the configuration of the slug reduction system 100 shown in FIG. 1, the slug reduction device 102 can provide slug reduction/prevention in the suction line of a heat pump system. By operating in the configuration of the slug reduction system 100 shown in FIG. 2, the slug reduction device 102 can serve as a charge compensator in the heat pump system.

In some alternative embodiments, the system 100 may use a different valve assembly or multiple valves instead of the valve assembly 104 to perform the operations of the system 100. For example, the pipe 112 and the pipe 114 may be coupled through a different flow path such as through a pathway that does not pass through the valve assembly 104.

Figure 3:
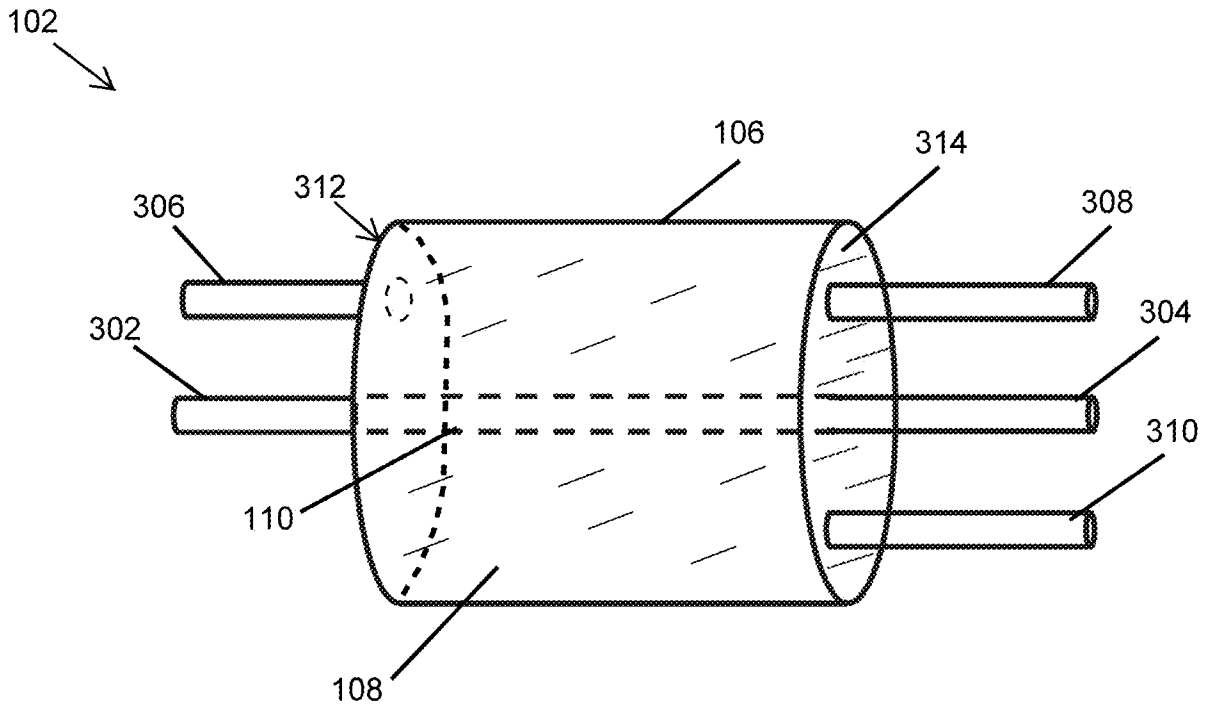
FIG. 3 illustrates the slug reduction device of the slug reduction system of FIGS. 1 and 2 according to an example embodiment.

FIG. 3 illustrates the slug reduction device 102 of the slug reduction system 100 of FIGS. 1 and 2 according to an example embodiment. As described above, the slug reduction device 102 may include the housing 106 that has the cavity 108. The slug reduction device 102 also includes a flash tube 110 extending through the cavity 108. The flash tube 110 may be a straight pipe as shown in FIG. 3 or may have another shape (e.g., a spiral shape) as the tube 110 extends through the cavity 110. The flash tube 110 provides a passageway through the cavity 108 for a refrigerant to pass through the cavity 108 confined within the tube 110 (i.e., not entering the cavity space outside of the flash tube 110).

In some example embodiments, the housing 106 may include flash tube ports 302, 304, an inlet port 306, an outlet port 308, and a liquid line port 310. The ports 302-310 may protrude out from the walls of the housing 106 as shown in FIG. 3. Alternatively, one or more of the ports 302-310 may not protrude out and may be formed by the walls of the housing 106. In some alternative embodiments, one or more of the ports 302-310 may protrude into the cavity 108. In some example embodiments, the ports 302-310 may integrally formed with the housing 106 or may be coupled to the housing 106, for example, by soldering or brazing.

In some example embodiments, the port 302 may be coupled to the housing 106 on one side of the housing 106, and the port 304 may be coupled to the housing 106 on an opposite side of the housing 106 from the port 302. For example, the port 302 may be coupled to an end wall 312 of the housing 106, and the port 304 may be coupled to an end wall 314 of the housing 106. Alternatively, one or both ports 302, 304 may be directly attached to the flash tube 110 instead of being directly attached to the housing 106. In some alternative embodiments, the flash tube 110 and the ports 302, 304 may be sections of a single pipe that is attached to the housing 106, where the ports 302, 304 are end sections of the flash tube 110 at opposite ends of the flash tube 110 and opposite sides of the housing 106. In some example embodiments, one or both ports 302, 304 may be openings in the housing 106 and may not extend outside of the wall of the housing 106.

In some example embodiments, the port 306 and the port 308 may be on opposite sides of the housing 106. For example, the port 306 may be attached to the end wall 312 and may provide a flow path into and out of the cavity 108. To illustrate, in FIGS. 1 and 2, the pipe 112 of the slug reduction system 100 may be attached to the port 306. For example, a hot gas refrigerant may flow from the pipe 112 into the cavity 108 through the port 306 in during slug reductions/prevention operations of the system 100 in the configuration shown in FIG. 1.

In some example embodiments, the port 308 may be attached to the end wall 314 and may provide a flow path into and out of the cavity 108. To illustrate, in FIGS. 1 and 2, the pipe 114 of the slug reduction system 100 may be attached to the port 308. For example, a hot gas refrigerant that enters the cavity 108 through the port 306 may exit the cavity 108 into the pipe 114 through the port 308 during slug reductions/prevention operations of the system 100 in the configuration shown in FIG. 1.

During normal cooling and heating operations, a refrigerant that is in the cavity 108 may enter the pipe 114 through the port 308 and/or enter the pipe 112 through the port 306. Alternatively or in addition, during normal cooling and heating operations, the refrigerant leaves the cavity 108 through the port 308 may return back to the cavity 108 through the pipe 112 and the port 306. If the refrigerant leaves the cavity 108 through the port 306 into the pipe 112, the refrigerant may return back to the cavity 108 through the pipe 114 and the port 308.

In some example embodiments, the port 310 may be attached to the end wall 314 and may provide a flow path into and out of the cavity 108. To illustrate, the pipe 140 shown in FIGS. 1 and 2 may be attached to the port 310, and refrigerant may be pulled into the cavity 108 through the port 310 during normal heat mode operations of a heat pump system, and the refrigerant may be put back into circulation through the port 310 during cooling mode operations.

As mentioned above, in some alternative embodiments, one or more of the ports 306, 308, 310 may be openings in the wall of the housing 106 without extending outside of the housing 106. For example, the pipe 112 shown in FIGS. 1 and 2 may be attached directly to the end wall 312 at the port 306 and establishing a flow path through the pipe 112 and the port 306. The pipe 114 may be similarly fluidly coupled to the port 308, and the pipe 140 may be similarly fluidly coupled to the port 310.

In some example embodiments, the part of the housing 106 between the end walls 312 and 314 may have a cylindrical, cube, rectangular, or spherical shape. Alternatively, the part of the housing 106 between the end walls 312 and 314 may have another shape without departing from the scope of this disclosure. In some example embodiments, one or both end walls 312, 314 may have a different shape than shown in FIG. 3 without departing from the scope of this disclosure. For example, one or both end walls 312, 314 may be dome shaped.

The sizes of the housing 106 and the ports 302-310 may depend on the capacity of the heat pump system that uses the slug reduction device 102 as can be readily understood by those of ordinary skill in the art with the benefit of this disclosure.

In some alternative embodiments, one or more of the ports 302-310 may be at a different location than shown without departing from the scope of this disclosure. For example, some of the ports that are shown as being on different sides of the housing 106 may be on the same side of the housing 106.

Figure 4:
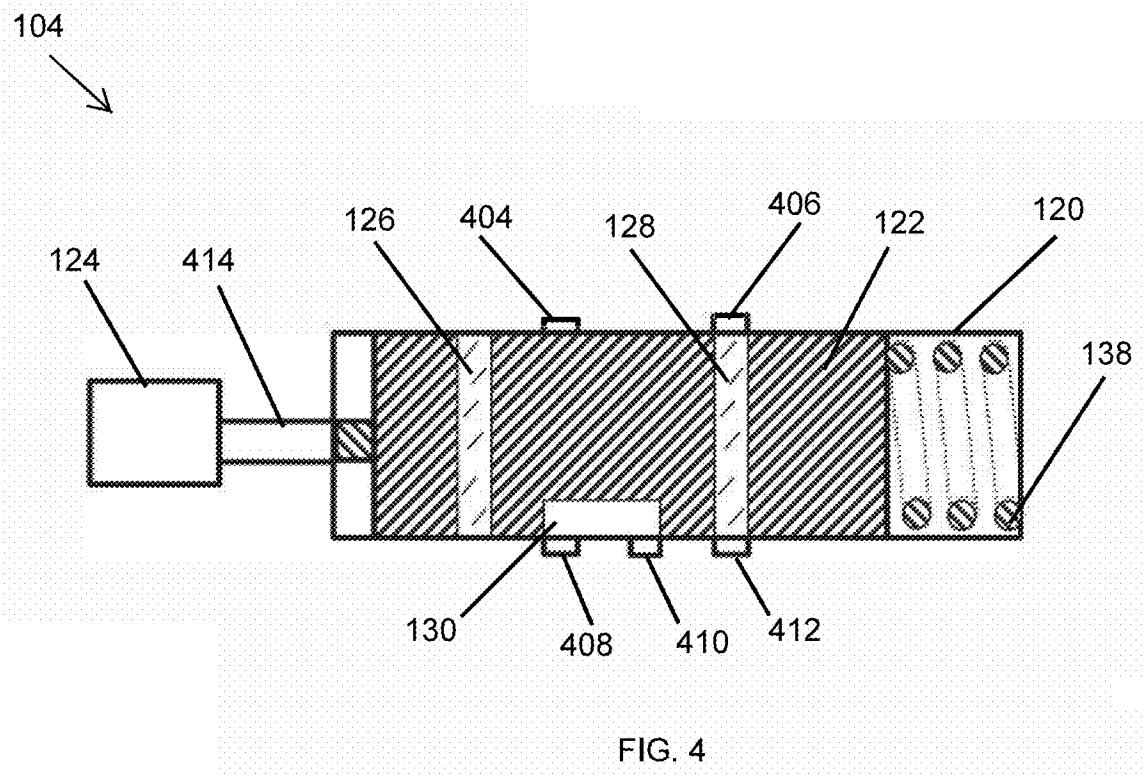
FIG. 4 illustrates the valve assembly of the slug reduction system of FIGS. 1 and 2 configured for use in refrigerant flashing operations of a heat pump system according to an example embodiment.
Figure 5:
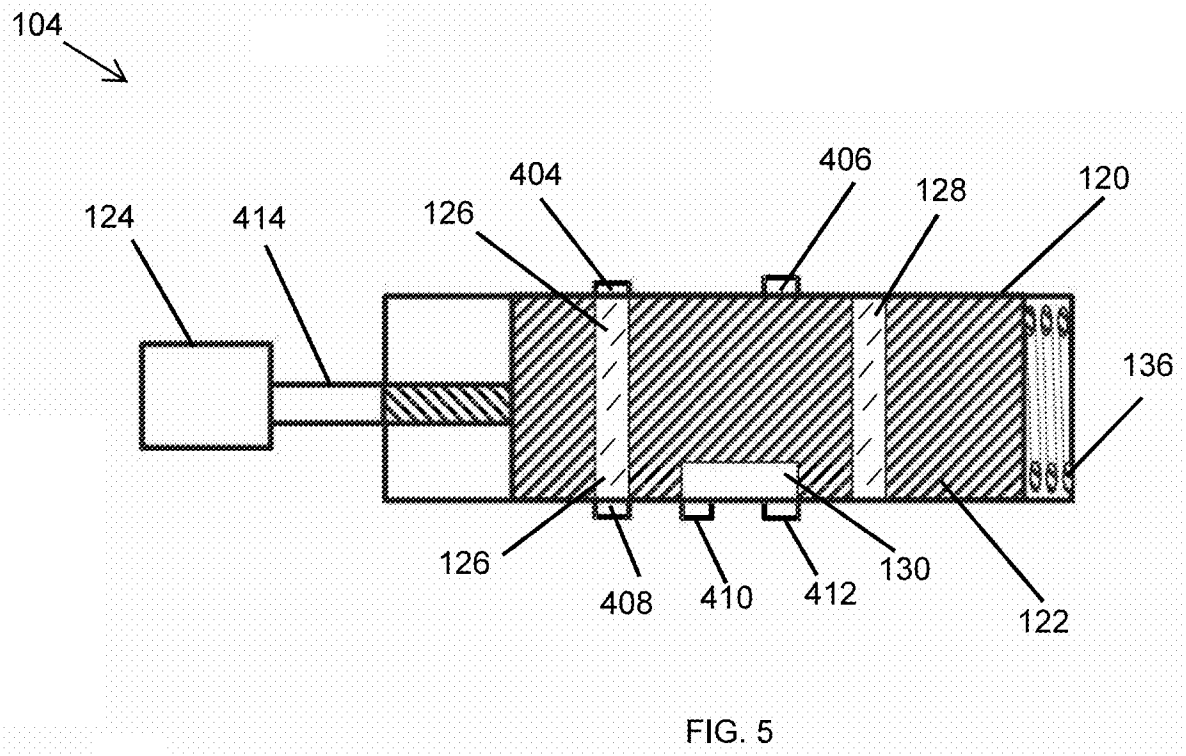
FIG. 5 illustrates the valve assembly of the slug reduction system of FIGS. 1 and 2 configured for use in normal heating and cooling operations of a heat pump system according to an example embodiment.

FIG. 4 illustrates the valve assembly 104 of the slug reduction system 100 of FIGS. 1 and 2 configured for use in refrigerant flashing (i.e., slug reduction/prevention) operations of a heat pump system according to an example embodiment. FIG. 5 illustrates the valve assembly of the slug reduction system of FIGS. 1 and 2 configured for use in normal (i.e., regular heating or cooling) operations of a heat pump system according to an example embodiment. As shown in FIG. 4, the valve assembly 104 is in the same configuration as in FIG. 1, and as shown in FIG. 5, the valve assembly 104 is in the same configuration as in FIG. 2.

As described above, in some example embodiments, the valve assembly 104 includes the housing 120, the valve core 122 that is inside of the housing 120, and the solenoid 124. The valve assembly 104 may also include the spring 138 that is inside the housing 120. The position of the valve core 122 inside the housing 120 may depend on the solenoid 124 and the spring 138. The solenoid 124 may be controlled by a control device such as the control device 604 shown in FIGS. 6 and 7.

In some example embodiments, the housing 120 includes ports/openings 404, 406, 408, 410, 412 that may provide a flow path into or out of the housing 120. One or more of the ports 404, 406, 408, 410, 412 may protrude out of the wall of the housing 120 as shown in FIG. 4. Alternatively, the ports 404, 406, 408, 410, 412 may be openings formed in the wall of the housing 120 without protruding out. In some example embodiments, the ports 404, 406, 408, 410, 412 may integrally formed with the housing 120 or may be coupled to the housing 120, for example, by soldering or brazing.

In some example embodiments, as shown in FIGS. 1 and 2, the pipe 132 may be coupled to the housing 120 or directly to the port 404 establishing a flow path between the port 404 and the pipe 132. The pipe 134 may be coupled to the housing 120 or directly to the port 406 establishing a flow path between the port 406 and the pipe 134. The pipe 150 may be coupled to the housing 120 or directly to the port 408 establishing a flow path between pipe 150 and the port 408. The pipe 112 may be coupled to the housing 120 or directly to the port 410 establishing a flow path between the port 410 and the pipe 112. The pipe 114 may be coupled to the housing 120 or directly to the port 412 establishing a flow path between pipe 114 and the port 412.

In some example embodiments, a shaft 414 of the solenoid 124 that extends into the housing 120 may be in a retracted position (relative to the housing 120), which allows the spring 138 to push the valve core 122 into the position shown in FIG. 4. In the position of the valve core 122 shown in FIG. 4, the flow passageway 128, which is formed through the valve core 122, is aligned with the ports 406 and 412 such that a refrigerant can flow through the valve core 122 and the housing 120. For example, refrigerant may flow from the pipe 114 to the pipe 134 through a flow path that includes the port 412, the flow passageway 128, and the port 406. In the position of the valve core 122 shown in FIG. 4, the flow channel 130 formed between the valve core 122 and the housing 120 may be aligned with the ports 408, 410. For example, as shown in FIG. 1, the flow channel 130 may provide a flow path between the pipe 150 and the pipe 112 that allows a hot gas refrigerant to flow from the pipe 150 to the cavity 108 of the housing 106 of the slug reduction device 102. In the position of the valve core 122 shown in FIG. 4, the flow passageway 126, which is formed through the valve core 122, may not be aligned with any of the ports of the housing 120, and thus, refrigerant may not flow in or out of the housing 120 through the passageway 126.

In some example embodiments, the shaft 414 of the solenoid 124 may be extended into the housing 120 such that shaft 414 pushes the valve core 122 and thereby compressing the spring 138 as shown in FIG. 5. In the position of the valve core 122 shown in FIG. 5, the flow passageway 126 is aligned with the ports 408 and 404 such that a refrigerant can flow through the valve core 122 and the housing 120. For example, refrigerant may flow from the pipe 150 to the pipe 132 through a flow path that includes the port 408, the flow passageway 126, and the port 404. In the position of the valve core 122 shown in FIG. 5, the flow channel 130 formed between the valve core 122 and the housing 120 may be aligned with the ports 410, 412. For example, as shown in FIG. 2, the flow channel 130 may provide a flow path between the pipe 114 and the pipe 112 that provides a closed loop with the cavity 108 of the housing 106 of the slug reduction device 102. In the position of the valve core 122 shown in FIG. 5, the flow passageway 128, which is formed through the valve core 122, may not be aligned with any of the ports of the housing 120, and thus, refrigerant may not flow in or out of the housing 120 through the passageway 128.

In some example embodiments, the housing 120 and the valve core 122 of the valve assembly 104 may also be made from copper, brass, another suitable material, or a combination of materials using methods such as spinning, cutting, milling, soldering, etc. The sizes of the housing 120, the ports 404-412, and the passageways 126, 128 may depend on the capacity of the heat pump system that uses the slug reduction device 102 as can be readily understood by those of ordinary skill in the art with the benefit of this disclosure.

In some alternative embodiments, the housing 120, the valve core 122, and the flow passageways 126, 128 may each have a different shape than shown in FIGS. 4 and 5 without departing from the scope of this disclosure. In some alternative embodiments, a different kind of spring may be used without departing from the scope of this disclosure. In some alternative embodiments, the housing 120 may have other ports/openings than shown without departing from the scope of this disclosure. In some alternative embodiments, the valve core 122 may have more flow passageways than shown without departing from the scope of this disclosure. In some alternative embodiments, the ports/openings of the housing 120 may be at different locations than shown without departing from the scope of this disclosure.

Figure 6:
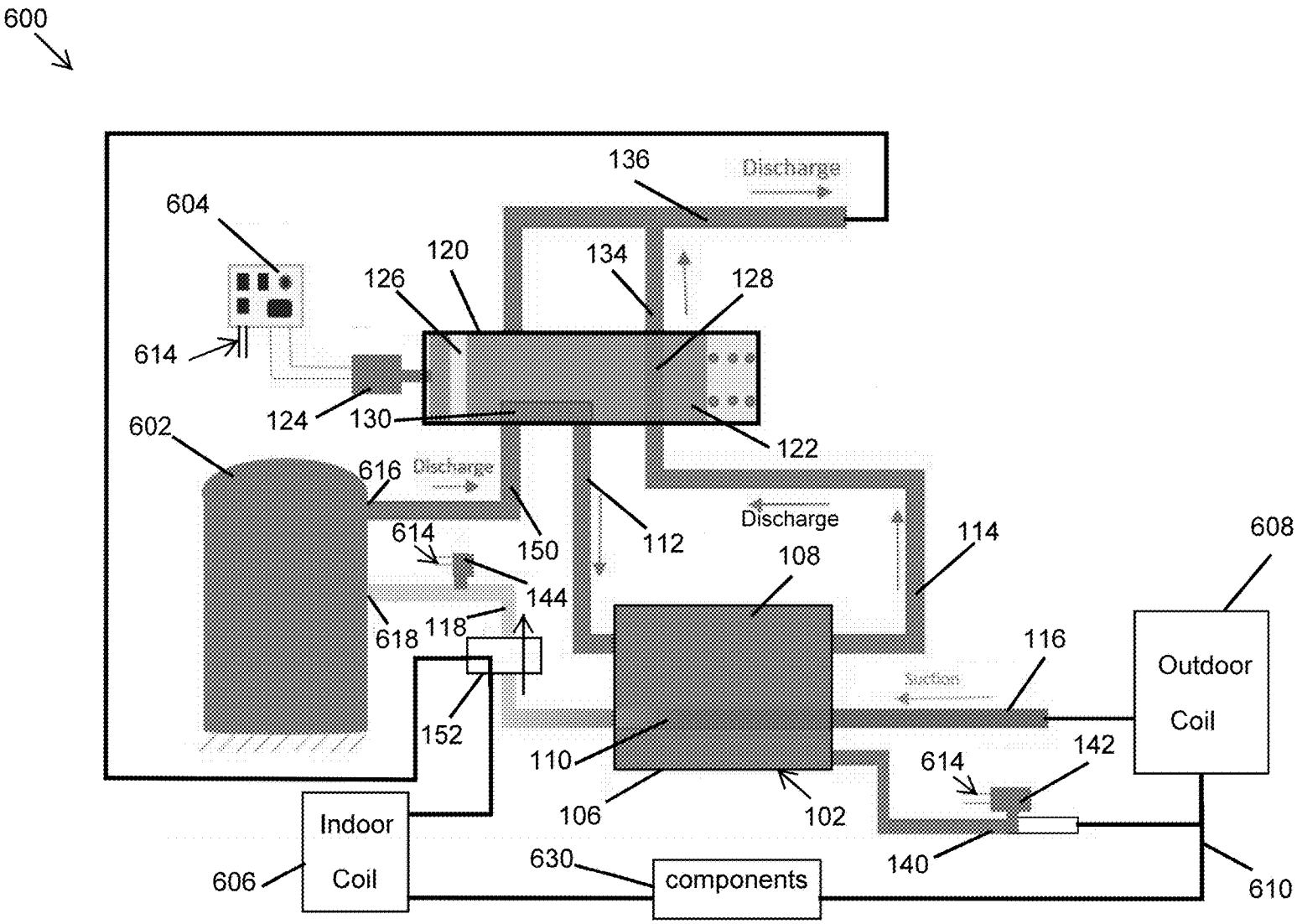
FIG. 6 illustrates a heat pump system that includes the slug reduction system of FIGS. 1 and 2 configured for use in refrigerant flashing operations according to an example embodiment.

FIG. 6 illustrates a heat pump system 600 that includes the slug reduction system 100 of FIGS. 1 and 2 configured for use in refrigerant flashing (i.e., slug reduction/prevention) operations according to an example embodiment. Referring to FIGS. 1 and 6, the heat pump system 600 includes a compressor 602 and a control device 604. The discharge line outlet 616 of the compressor 602 is fluidly coupled to the pipe 150 such that a hot gas refrigerant can flow from the compressor 602 to cavity 108 of the housing 106 of the slug reduction device 102 through the pipe 150, the channel 130 of the valve assembly 104, and the pipe 112. The hot gas refrigerant that enters the cavity 108 may exit the cavity 108 into the pipe 114 and flow through the passageway 128 into the pipe 134 that is fluidly coupled to the pipe 136, which may be a section of the discharge line piping of the heat pump system 600.

In some example embodiments, the hot gas refrigerant that flows through the cavity 108 may flash (i.e., vaporize) liquid refrigerant that may enter the flash tube 110 through the pipe 116 that may be fluidly coupled to an outdoor coil 608. For example, the refrigerant that enters the flash tube 110 may be entirely or partially in liquid form, and all or a portions of the liquid refrigerant may be flashed by the hot gas refrigerant in the cavity 108. Refrigerant that entered the pipe as liquid may be flashed into vapor and flow out of the flash tube 110 to the suction line inlet 618 of the compressor 602 through the reversing valve 152 and the pipe 118.

In some example embodiments, the hot gas refrigerant that flows through the valve assembly 104 to the pipe 136 flows to the reversing valve 152. The reversing valve 152 may be configured to direct the refrigerant to an indoor coil 606 during slug reduction/prevention operations of the heat pump system 600.

In some example embodiments, the heat pump system 600 may be configured as shown in FIG. 6 when the heat pump system 600 is started up after being idle or off. For example, at start up, the control device 604 may control the solenoid 124 such that the valve core 122 is positioned as shown FIGS. 1 and 6. At start up, the control device 604 may also control the flow valve 142 such that the pipe 140 is closed, preventing refrigerant to flow into and out of the cavity 108 from and to the liquid line 610 of the heat pump system 600.

In some example embodiments, the control device 604 may include a controller, such as a microcontroller, an FPGA, etc. and other supporting components (e.g., a memory device that may be used to store data and executable code). The control device 604 may be coupled to the solenoid 124 via one or more electrical wires and may control the solenoid 124 electrically via the wires. In some example embodiments, the control device 604 may control the flow valve 140 via one or more electrical wires 614 that are coupled to the control device 604 and the flow valve 140.

In some example embodiments, the control device 604 may control the solenoid 124 and the valve 140 as shown in FIGS. 1 and 6 based on information from the sensor 144. For example, the control device 604 may control the solenoid 124 and the valve 140 to change the configuration of the heat pump system 600 from a normal heating or cooling mode configuration (e.g., the heating mode configuration shown in FIG. 7) to the slug reduction/prevention configuration shown in FIG. 6 based on information from the sensor 144.

In some example embodiments, the sensor 144 may include temperature and pressure sensors that provide to the control device 604 temperature and pressure information in the pipe 118 (which is fluidly coupled to the suction line inlet 618 of the compressor 602). The control device 604 may process the information from the sensor and determine whether the refrigerant in the pipe 118 is at least partially in liquid form, for example, based on known information stored in the control device 604 correlating temperature and pressure to different states of refrigerant. For example, the control device 604 may determine whether superheat is present in the pipe 118. Alternatively, the sensor 144 may be or may include a liquid sensor (e.g., a float based liquid sensor) that senses the presence of liquid refrigerant in the pipe 118. For example, the sensor 144 may indicate that the detection of liquid refrigerant when the amount of the liquid refrigerant exceeds a threshold amount based on the setting of the sensor or upon detection of any liquid refrigerant.

Figure 7:
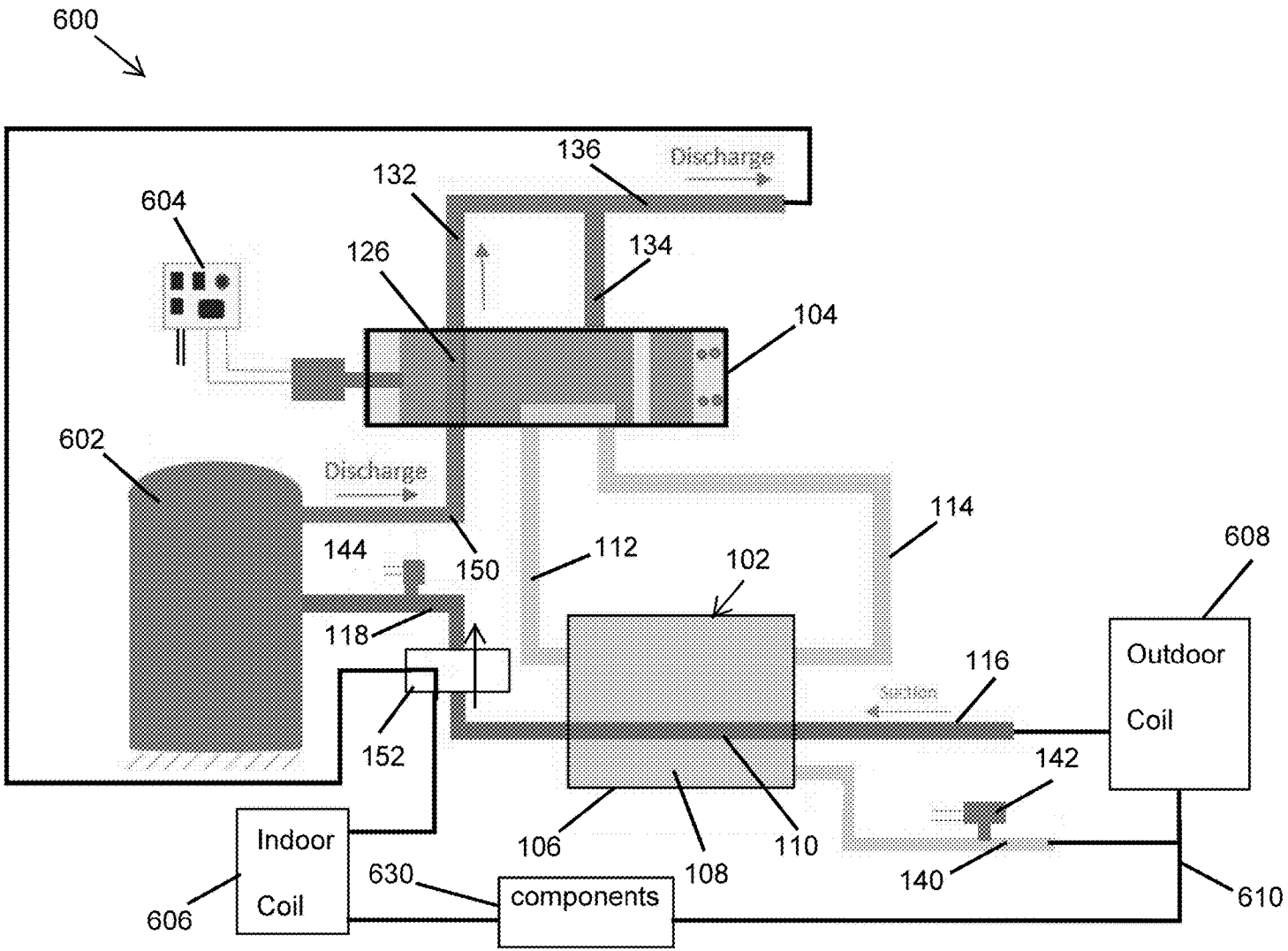
FIG. 7 illustrates the heat pump system that includes the slug reduction system of FIGS. 1 and 2 configured for use in normal heating operations according to an example embodiment.

In some example embodiments, the heat pump system 600 may switch or transition from the slug reduction/prevention configuration shown in FIG. 6 to the normal heating mode configuration shown in FIG. 7 (or to a normal cooling mode configuration) after operating in the slug reduction/prevention configuration for a period of time that depends on a number of factors including system capacity, etc. For example, the period of time that the heat pump system 100 operates in the slug reduction/prevention configuration of FIG. 6 may depend on the capacity of the heat pump system 600. In some example embodiments, the heat pump system 600 may switch or transition from the slug reduction/prevention configuration shown in FIG. 6 to the normal heating mode configuration shown in FIG. 7 (or to a normal cooling mode configuration) if no liquid refrigerant is indicated or detected in the pipe 118 (i.e., a suction line pipe) of the heat pump system 600 by the sensor 144 for a period of time that depends on a number of factors including system capacity, etc.

In some example embodiments, the heat pump system 600 may include components 630 (e.g., expansion valve, etc.) as well as other components than shown without departing from the scope of this disclosure. In some alternative embodiments, the system 600 may include multiple sensors instead of the single sensor 144. In some alternative embodiments, the heat pump system 600 may use one or more valves instead of the valve assembly 104 without departing from the scope of this disclosure. In some alternative embodiments, some of the components and pipes of the heat pump system 600 may be coupled or configured differently than shown without departing from the scope of this disclosure. In some alternative embodiments, one or more components of the heat pump system 600 may be omitted or combined without departing from the scope of this disclosure. For example, when the heat pump system 600 is implemented for heating mode or cooling mode only, the reversing valve 152 may be omitted and relevant pipes may be coupled as can be readily understood by those of ordinary skill in the art with the benefit of this disclosure.

FIG. 7 illustrates the heat pump system 600 that includes the slug reduction system 100 of FIGS. 1 and 2 configured for use in normal heating operations according to an example embodiment. To illustrate, the control device 604 may control the solenoid 124 such that the valve core 122 is positioned in the housing 110 to allow a hot gas refrigerant to flow from the discharge line outlet 616 of the compressor 602 to flow to the pipe 136 through the pipe 150, the passageway 126, and the pipe 132. The hot gas refrigerant may flow from the pipe 136 to the reversing valve 152 that directs the hot gas refrigerant to the indoor coil 606 during heating mode operations and to the pipe 116 through the flash tube 110 during cooling mode operations.

When the heat pump system 600 is configured for heating mode operations, refrigerant flows from the outdoor coil 608 to the suction line inlet 618 of the compressor 602 through the pipe 116, the flash tube 110, the reversing valve 152, and the pipe 118. The control device 604 may control the flow valve 142 so that the valve 142 is open resulting in an open flow path between the cavity 108 of the housing 106 of the slug reduction device 102 and the liquid line 610. Some of the refrigerant circulating through the heat pump system 600 may be pulled out into the cavity 108 during the normal heating mode operation.

During cooling mode operations, the reversing valve 152 fluidly couples the indoor coil 606 with the pipe 118, and the hot gas refrigerant flowing through the pipe 136 is directed by the reversing valve 152 to the outdoor coil 608 through the flash tube 110 and the pipe 116 (i.e., in opposite direction from the suction arrow). The refrigerant that is pulled out of circulation into the cavity 108 during the heating mode is returned to the liquid line 610 through the pipe 610, where the valve 142 controlled by the control device 604 is open to allow the flow to the liquid line 610.

In some example embodiments, the control device 604 may change the configuration of the heat pump system 600 to slug reduction/prevention configuration shown in FIG. 6 if the control device 604 determines that liquid is detected in suction line (e.g., the pipe 118) of the heat pump system 600. Alternatively or in addition, the heat pump system 600 may be switched between slug reduction/prevention and normal heating/cooling mode configurations/operations in response to user inputs that, for example, may be provided to the control device 604.

In some example embodiments, the heat pump system 600 may include components other than shown in FIG. 7 without departing from the scope of this disclosure. For example, the heat pump system 600 may include valve(s), filter(s), drier(s), etc. in one or more of the refrigerant lines as can be readily understood by those of ordinary skill in the art with the benefit of this disclosure.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A slug reduction system for use in heat pump systems, the slug reduction system comprising:

a slug reduction and charge compensator device, comprising:

a housing having a cavity and a liquid line port providing a refrigerant pathway into and out of the cavity; and a flash tube extending through the cavity and providing a passageway through the cavity for a suction line refrigerant to flow through the flash tube;

a sensor configured to detect one or more parameters of the suction line refrigerant indicative of the suction line refrigerant being at least partially in a liquid form; and a valve assembly in electrical communication with the sensor, wherein in response to the sensor detecting the one or more parameters of the suction line refrigerant indicative of the suction line refrigerant being at least partially in the liquid form, the valve assembly is configured to fluidly couple the cavity and a hot gas refrigerant pipe via an inlet port of the housing, the hot gas refrigerant pipe directing a hot gas refrigerant from a compressor to the cavity.

2. The slug reduction system of claim 1, wherein a coupling pipe provides a flow path for the hot gas refrigerant to exit the cavity through an outlet port of the housing and flow to the valve assembly.

3. The slug reduction system of claim 2, wherein the coupling pipe and a second coupling pipe are fluidly coupled to the cavity, wherein the second coupling pipe is fluidly coupled to the cavity through the inlet port of the housing, and wherein the valve assembly is further configured to control whether the coupling pipe is fluidly coupled to the second coupling pipe outside of the housing.

4. The slug reduction system of claim 3, wherein the coupling pipe is uncoupled from the second coupling pipe outside of the housing when the cavity is fluidly coupled to the hot gas refrigerant pipe.

5. The slug reduction system of claim 1, wherein the valve assembly is configured to provide a flow channel through the valve assembly for the hot gas refrigerant to flow from the hot gas refrigerant pipe to the cavity.

6. The slug reduction system of claim 1, wherein a flow valve controls whether a flow path to and from the cavity through the liquid line port is open or closed.

7. The slug reduction system of claim 6, wherein the flow path to and from the cavity through the liquid line port is closed when the cavity is fluidly coupled to the hot gas refrigerant pipe.

8. A heat pump system, comprising:

a compressor;

a slug reduction and charge compensator device comprising:

a housing having a cavity and a liquid line port providing a refrigerant pathway into and out of the cavity; and a flash tube extending through the cavity, wherein the flash tube provides a passageway through the cavity for a suction line refrigerant to flow through the flash tube;

a sensor configured to detect one or more parameters of the suction line refrigerant indicative of the suction line refrigerant being at least partially in a liquid form; and a valve assembly in electrical communication with the sensor, wherein in response to the sensor detecting the one or more parameters of the suction line refrigerant indicative of the suction line refrigerant being at least partially in the liquid form, the valve assembly is configured to fluidly couple the cavity and a discharge line outlet of a compressor via an inlet port of the housing to receive a hot gas refrigerant from the compressor.

9. The heat pump system of claim 8, wherein a coupling pipe that is fluidly coupled to the valve assembly provides a flow path for the hot gas refrigerant to exit the cavity through an outlet port of the housing and flow to the valve assembly.

10. The heat pump system of claim 9, wherein the coupling pipe and a second coupling pipe are fluidly coupled to the cavity, wherein the second coupling pipe is fluidly coupled to the cavity through the inlet port of the housing, and wherein the valve assembly is further configured to control whether the coupling pipe is fluidly coupled to the second coupling pipe outside of the housing.

11. The heat pump system of claim 10, wherein the coupling pipe is uncoupled from the second coupling pipe outside of the housing when the cavity is fluidly coupled to the discharge line outlet.

12. The heat pump system of claim 8, further comprising a control device and a flow valve that controls whether a flow path to and from the cavity through the liquid line port is open or closed, wherein the control device controls operations of the flow valve and the valve assembly.

13. The heat pump system of claim 12, wherein the control device controls the operations of the flow valve and the valve assembly based on information from the sensor.

* * * * *